United States Patent [19]

Brasseur et al.

[11] Patent Number: 4,512,306

[45] Date of Patent: Apr. 23, 1985

[54] DEVICE FOR SHUTTING DOWN A FUEL INJECTION COMBUSTION ENGINE

[75] Inventors: Georg Brasseur, Vienna; Heinz Rathmayr, Hallein, both of Austria

[73] Assignee: Friedmann & Maier Aktiengesellschaft, Hallein, Austria

[21] Appl. No.: 512,026

[22] Filed: Jul. 8, 1983

[30] Foreign Application Priority Data

Jul. 9, 1982 [AT] Austria ..... 2686/82

[51] Int. Cl.[3] ..... F02D 31/00

[52] U.S. Cl. ..... 123/367; 123/372

[58] Field of Search ..... 123/367, 366, 372, 373, 123/374, 365, 198 DB

[56] References Cited

U.S. PATENT DOCUMENTS

| | | | |
|---|---|---|---|
| 2,708,921 | 5/1955 | Links | 123/367 |
| 4,243,004 | 1/1981 | Ritter et al. | 123/367 |
| 4,350,127 | 9/1982 | King | 123/367 |
| 4,372,267 | 2/1983 | Adams | 123/367 |

FOREIGN PATENT DOCUMENTS

| | | | |
|---|---|---|---|
| 1197275 | 11/1961 | Fed. Rep. of Germany | 123/373 |
| 2533630 | 4/1976 | Fed. Rep. of Germany . | |
| 160499 | 9/1957 | Sweden | 123/367 |
| 816449 | 7/1959 | United Kingdom . | |

*Primary Examiner*—Magdalen Y. C. Moy

*Attorney, Agent, or Firm*—Cushman, Darby & Cushman

[57] ABSTRACT

For shutting down a fuel injection combustion there is provided a spring-loaded and lockable stop (8), the locking member (13) of which can be retracted in a controlled manner by an operation paramenter, e.g. the number of revolutions. In the released position, the stop (8) acts on the fuel amount control rod (1) and moves this rod into zero-delivery position. Adjustment of the fuel amount control-rod (1) is effected by means of a servomotor, noting that on starting the fuel injection combustion engine the stop (8) is drawn by this servomotor into a position in which the stop is maintained by the locking member (13) until retracting same. This locking position of the lockable stop (8) simultaneously represents a stop for the maximum amount of fuel supplied by the injection pump and the fuel amount control rod can, during operation, be adjusted to any desired and just required amount of fuel supplied. If there occurs an inadmissible operating condition, e.g. an overspeed, the lockable stop (8) is released and can, with the aid of the force of the pretensioned shutdown spring, retract the control rod (1) into zero-delivery position out of any position of the control rod.

9 Claims, 8 Drawing Figures

Figure 3:
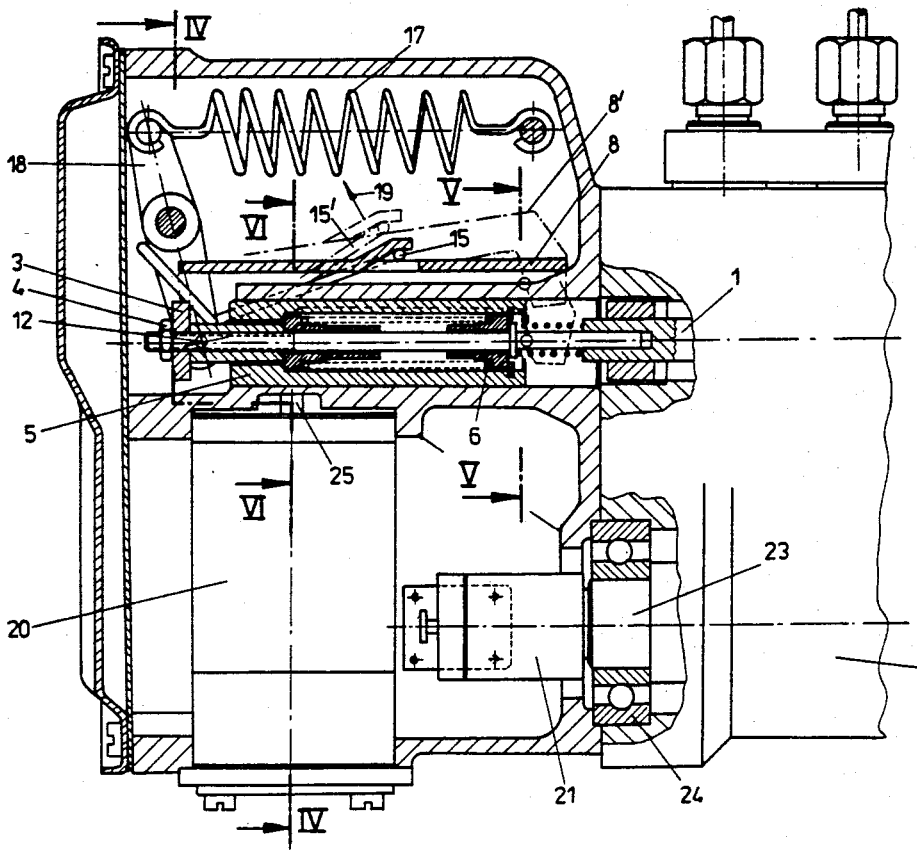

FIG. 1
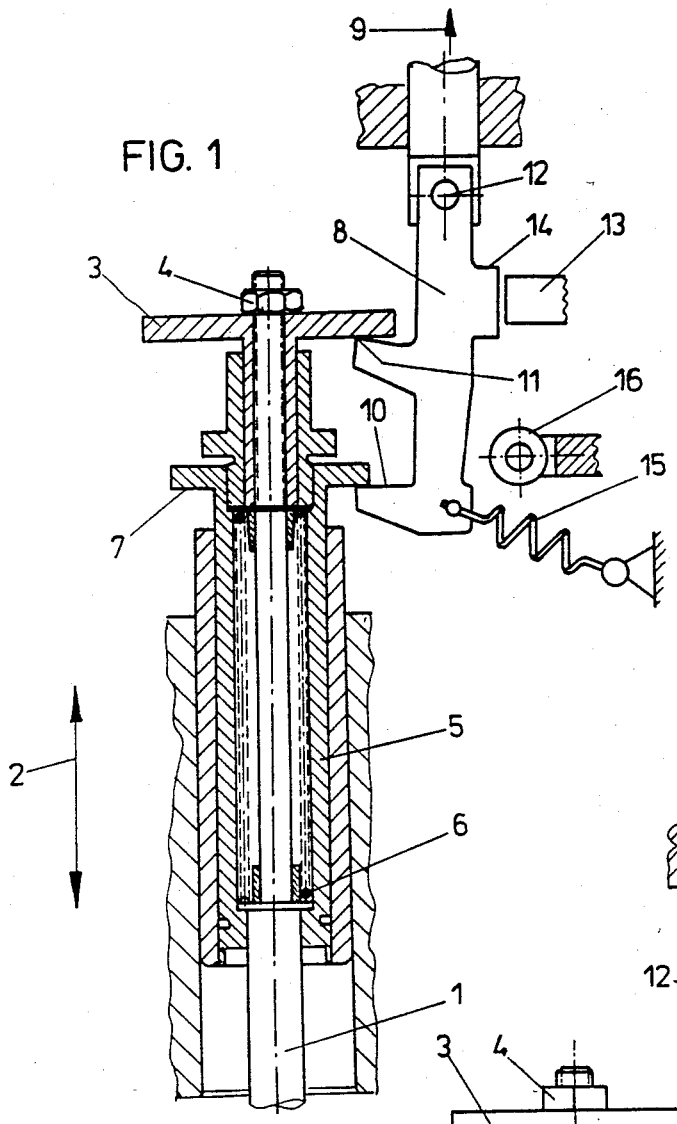
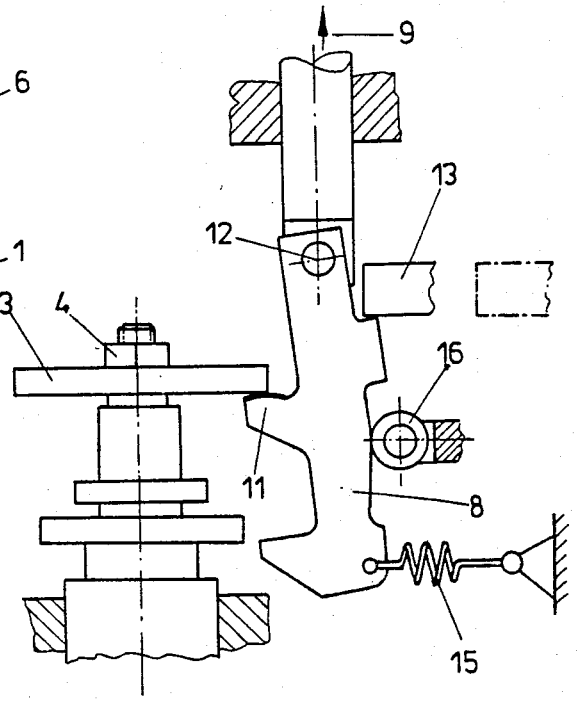
FIG. 2

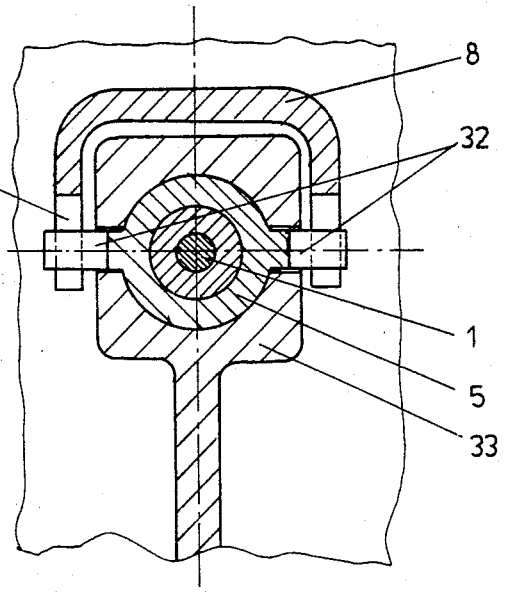
FIG. 5
FIG. 6
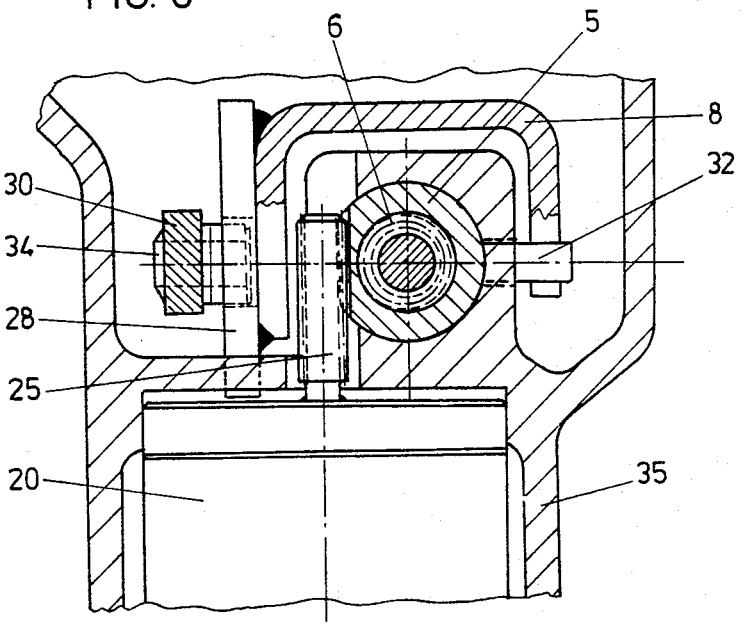

DEVICE FOR SHUTTING DOWN A FUEL INJECTION COMBUSTION ENGINE

The invention refers to a device for shutting down a fuel injection combustion engine, in which a fuel amount control rod of an injection pump is cooperating with an adjustable stop adapted to be locked, in operation, by a locking member in a position giving free the whole adjusting range of the fuel amount control rod and being acted upon in its locked position by a shut-down spring in the sense of moving the fuel amount control rod to zero-delivery, the locking member being releasable in dependence on an operating condition. In fuel injection combustion engines it is already known to adjust the fuel amount control rod during operation in dependence on the rotating speed, the intake pressure, the atmospheric pressure, the temperature or other parameters to obtain a complete and smokeless combustion. It is further known to limit the maximum amount of fuel supplied by a separate adjustable stop being adjusted in dependence on operating parameters. The shut-down of fuel injection combustion engines must reliably be effected if the combustion engine runs with too high a number of revolutions. Particularly with electronic control equipments, the fuel injection combustion engine must automatically be shut down in case of troubles in the current supply which troubles detract from an unobjectionable function of the electronic control. As shut-down device activated in case of overspeed there are already known simple centrifugal force switches which on responding either interrupt the current supply or close a current circuit for actuating an electric valve. In the known applications only the fuel supply was interrupted in this manner, which resulted in a certain time lag which may already cause a damage of the fuel combustion engine.

From the DE-OS No. 25 33 630 there is already known a device in which a spring-loaded pivotable stop is immediately cooperating with a fuel amount control rod. This pivotable stop must first be brought into a position in which the spring is pretensioned and is maintained in this position by a locking pin as long as the locking pin has not been released. After releasing the locking pin, this pivotable stop swivels under the action of the pretensioned spring and thereby moves the fuel amount control rod in its zero-position.

The invention now aims at providing a simple and operationally safe device of the type initially mentioned, in which the spring force, required for the shut-down, of the stop can be generated immediately during starting the fuel combustion engine by winding up the shutdown spring with the aid of a servomotor or resp., a stepping motor being, as a rule, used for adjusting the fuel amount control rod during operation. The advantages of the known embodiment, in which the locking means of such a spring-loaded stop need only support a fraction of the shut-down forces proper and can thus be released with a comparatively low expenditure of force, shall fully be maintained with this embodiment. For solving this task the invention essentially consists, based on the above-mentioned device, in that the adjusting member for adjusting the fuel amount is actuated by a servomotor, in particular a stepping motor, and is acting on the fuel amount control rod with interposition of a drag spring, in that the lockable stop is connected with a further stop cooperating, on adjusting the adjusting member in direction of maximum fuel supply of the fuel amount control rod, with a counter stop of the adjusting member, the shut-down spring thereby being tensioned until engagement of the locking member in the lockable stop, and in that in operation the further stop is out of engagement with the counterstop of the adjusting member. With this embodiment it is now only necessary to provide in the electronic control a corresponding starting program. In view of the adjusting member, actuated by a servomotor and particularly by a stepping motor, for the fuel amount adjustment acting on the fuel amount control rod with interposition of a drag spring, it is made sure that shut-down into the zero-delivery position is effected independent of the position of the adjusting member even if troubles have occured within the force transmission chain from the servomotor to the adjusting member. By these measures, the adjusting member is immediately prior to the starting operation brought into a position corresponding to the maximum fuel supply capacity provided by the fuel amount supply rod, or, resp., into a position slightly exceeding this supply capacity and takes along, within this adjustment path, the lockable stop against the force of the shut-down spring. Thereby, the shutdown spring is tensioned till the locking member becomes engaged within the stop and remains tensioned even if later on the adjustment member is retracted by the servomotor in direction to zero-delivery into the corresponding operating position. After retracting the adjusting member, the lockable stop arrives at a position in which the further stop can no more collide with the counterstop of the adjusting member, so that the lockable stop can only become again effective if the locking member is released and the fuel amount control rod is moved in direction to zero-delivery by the force of the shut-down spring.

In a simple manner, the lockable stop can be locked by the armature of an electromagnet which leaves free the adjusting path of the stop in deenergized condition. Such an armature of an electromagnet can, in this case, be caught within a recess of the lockable stop and be put out of the locking position by a retracting spring when the electromagnet becomes deenergized. In an advantageous manner the arrangement can, however, be such that the locking member is formed of a displaceable pin engaging a bent gate-type guide of the lockable stop. In this case, and for further locking the necessary releasing forces, the pin can be provided with a roller which can be caught within a part of the gate-type guide. When using such gate-type guide, the displaceable pin engaging the gate-type guide can, in an advantageous manner, be displaceable against the force of a restoring spring, in particular by means of a centrifugal force measuring means, so that there can be taken in consideration by shutting down the fuel combustion engine not only disturbances in the current supply but also any inadmissible overspeed occurring.

The arrangement can be such that the lockable stop and the further stop are arranged on a pivotally supported lever acted upon by a spring and that the stop is arranged at a smaller distance from the pivotal axis of the lever that is the further stop. In this manner, the further stop can, after having tensioned or wound up the shutdown spring, be brougth into a particularly simple manner out of engagement with the counterstop of the adjusting member, which is necessary for an unobjectionable operation of the control device. In a particularly simple manner the arrangement is such that the further stop is formed of a hook-like part of the lockable stop, which, in a first pivotal position of the lockable stop, grips over counterstops or protrusions, in particular carrier bolts, of the adjusting member, and which, in a second pivotal position corresponding to the operating position, is out of engagement with the counterstops or resiliently pressed into the pivotal position corresponding to the operating position. In this manner, there is provided a constructionally particularly simple embodiment.

In the following, the invention is further explained with reference to embodiments shown in the drawing.

In the drawing

Figure 4:
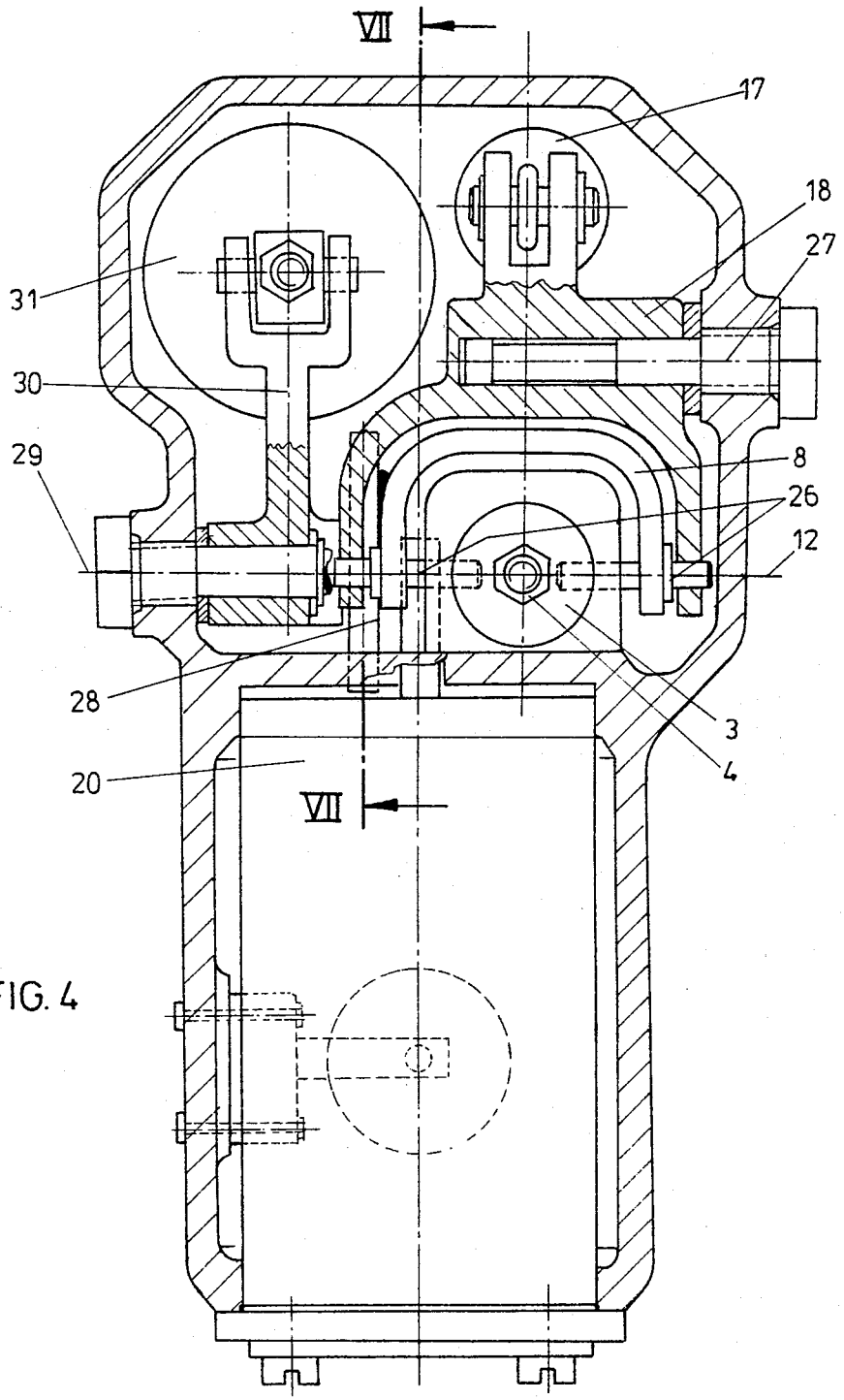
Figure 7:
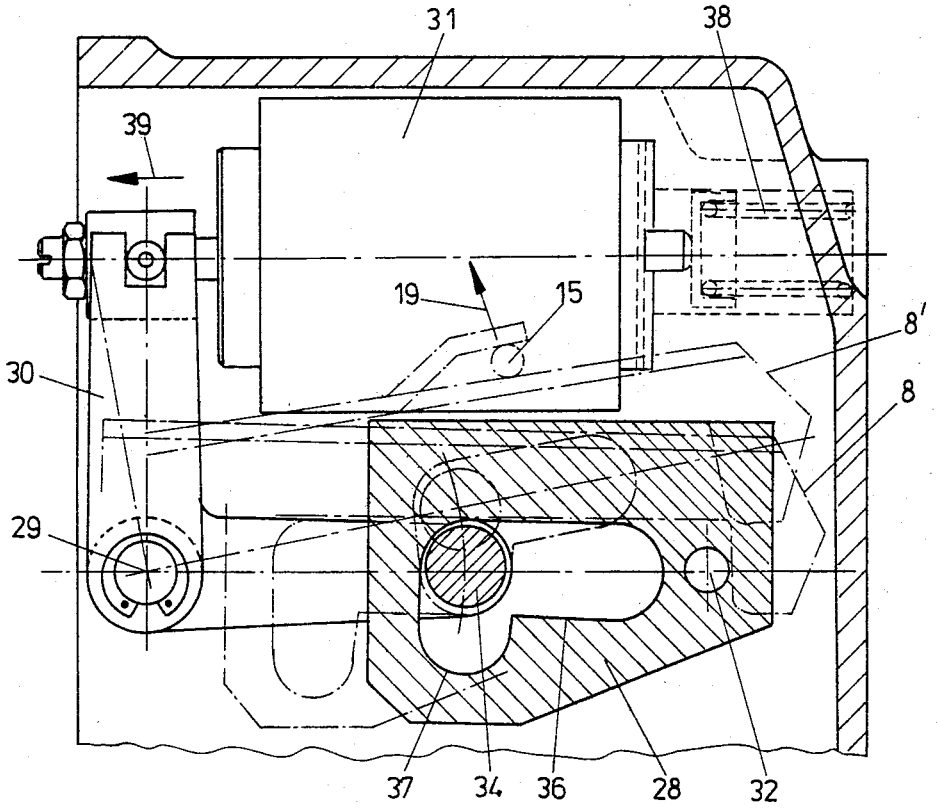
Figure 8:
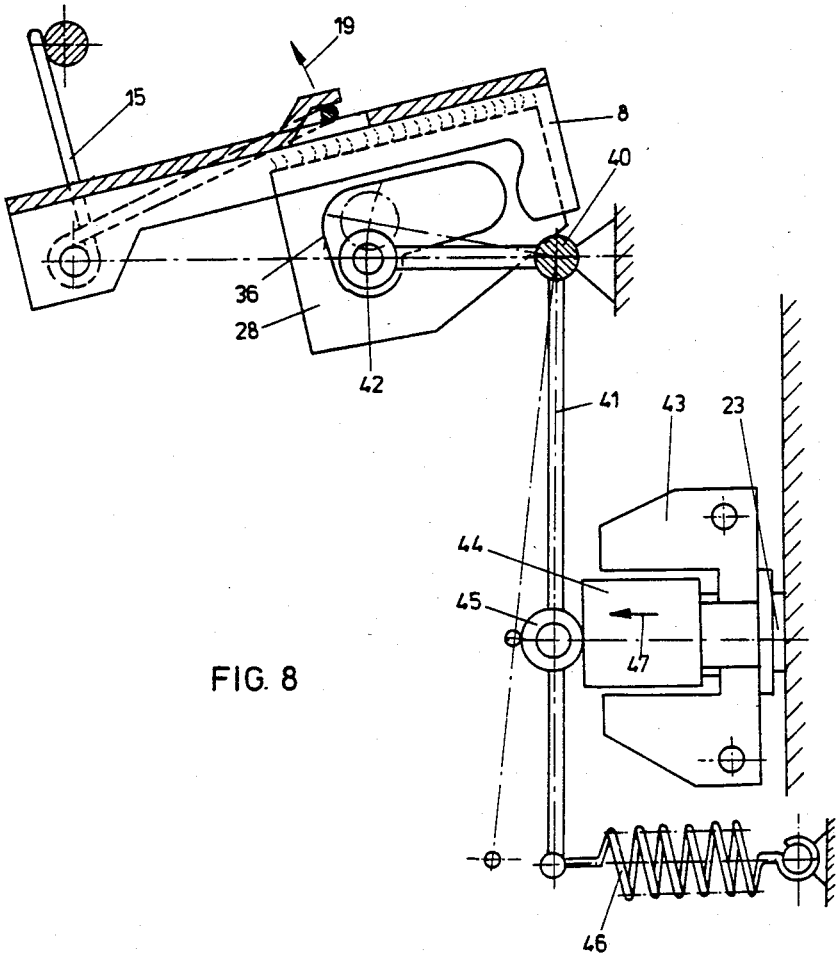

FIG. 1 shows a schematic representation of the end of the control rod, of the adjusting member as well as of the lockable stop in shut-down condition of the fuel combustion engine, FIG. 2 shows an analogous representation of the lockable stop in the operating position, FIG. 3 shows a section through a governor for a fuel injection pump, FIG. 4 shows a section along line IV—IV of FIG. 3, FIG. 5 shows a section along line V—V of FIG. 3, FIG. 6 shows a section along the line VI—VI of FIG. 3, FIG. 7 shows a section along the line VII—VII of FIG. 4, and FIG. 8 shows a schematic representation which is analogous to the representation of FIG. 7 and has an additional centrifugal force measuring means.

In FIG. 1 the fuel amount control rod of the fuel injection pump is designated 1. Shifting of the control rod 1 in the sense of the double-arrow 2 in upward direction results in a reduction of the fuel amount supplied and shifting in the sense of the double-arrow 2 in downward direction results in an increase of the amount of fuel supplied by the injection pump. A counterstop formed of a plate 3 is rigidly connected with the control rod 1 and can be fixed in its selected position by means of nuts 4. Adjustment of the control rod 1 is effected by means of an adjusting member designed as a toothed rack 5 meshing with the pinion of a stepping motor not shown. A drag spring 6 is arranged between the toothed rack 5 designed as a hollow body and the control rod 1 and stores the required adjusting stroke predetermined by the stepping motor if it is just impossible to adjust the control rod 1. A counterstop 7 is rigidly connected with the toothed rack 5.

Said both counterstops 3 and 7 now cooperate with a lockable stop 8 which is connected with a shutdown spring. The direction of action of the shutdown spring is indicated by the arrow 9. The lockable stop 8 is designed as a hook whose hook-shaped end portion 10 grips over the counterstop 7 of the toothed rack in shut-down condition of the fuel combustion engine. Further, the stop 8 grips with a protrusion 11 over the counterstop of the fuel amount control rod, so that the control rod 1 is drawn into stop position if the lock is released. The lockable stop 8 is in this case arranged for pivotal movement around a pivotal axis 12. The locking member is formed of the armature 13 of an electromagnet which in operation is caught behind a corresponding recess 14 of the stop 8.

Prior to starting the fuel combustion engine, the toothed rack 5 is downwardly shifted in direction of the double-arrow 2 by the stepping motor, the control rod 1 thus being moved into the full-load position with an additional predetermined surplus stroke. During this movement of the toothed rack 5 as well as of the control rod 1, the lockable stop 8 is downwardly drawn in opposite direction to the direction 9 of action of the shut-down spring and the shut-down spring is thus pretensioned as soon as the armature 13 of the electromagnet can enter the corresponding recess 14. The stop 8 is swivelled by means of a tension spring 15 around its pivotal axis 12 into the operating position shown in FIG. 2.

According to FIG. 2, the armature 13 of the electromagnet is supported in the recess 15 of the lockable stop 8, the hook-shaped end portion 10 being swivelled out of the path of movement of the counterstop 7. The swivelling movement of the lockable stop 8 around the pivotal axis 12 is limited by a stop roll 16. In the position of FIG. 2, the maximum amount of fuel supplied by the injection pumps during operation is defined by the protrusion 11 of the lockable stop 8 and the counterstop 3 can be shifted out of this full-load position into any suitable operating position by means of the toothed rack 5 with interposition of the drag spring 6. When retracting the armature 13 of the electromagnet, locking of the stop 8 is ceased and this stop is retracted in direction of the arrow 9 by means of the force of the pretensioned shut-down spring, the counterstop 3 and therewith the control rod 1 is drawn into the stop position.

FIG. 3 shows in detail a constructional embodiment of such a governor. The shut-down spring is designated 17 and acts via a two-armed lever 18 on the counterstop 3 of the control rod. The pivotal axis 12 of the lockable stop 8 is arranged on the free end of this two-armed lever 18. The spring 15 is thus pretensioned in the sense of the arrow 19 and swivels this stop 8, after locking the stop, into the position 8', the spring assuming the position 15'. The drag spring is again designated 6. In addition to the reference characters of FIGS. 1 and 2, the stepping motor is designated 20 and a centrifugal force measuring means is designated 21 in FIG. 3. The fuel injection combustion engine is indicated by the reference character 22, noting that the cam shaft 23 of the fuel injection combustion engine 22 drives the centrifugel force measuring means 21 and is supported by bearings 24 within the motor 22.

The pinion 25 of the stepping motor 20 meshes with the toothed rack 5, shifting movement of the toothed rack 5 being transmitted onto the control rod 1 with interposition of the drag spring 6.

The position of the lockable stop 8 shown in FIG. 3 corresponds to that position which allows to wind up the shut-down spring 17, the toothed rack 5 thereby being moved by the stepping motor 20 in right-hand direction and in the direction to the full-load position of the control rod 1.

In FIG. 4, there is shown the counterstop 3 of the fuel amount control rod 1, said counterstop being engaged by carrier bolts 26. These carrier bolts 26 form the pivotal axis 12 of the lockable stop 8 and simultaneously form also the linking axis of the two-armed lever 18 being pivotable around an axis 27 stationarily arranged relative to the housing, said lever being acted upon by the shut-down spring 17. A gate-type guide 28 is rigidly connected with the lockable stop 8 and is clearly shown in the FIGS. 7 and 8. This gate-type guide 28 is engaged by a pin being supported for pivotable movement around an axis 29 stationarily arranged relative to the housing, pivotal movement being effected by means of a bell-crank lever 30 and a solenoid 31.

In FIG. 5 there is shown that the counterstop 7 of the toothed rack 5 is formed of carrier bolts 32 rigidly connected with the toothed rack and engaging the hook-shaped end portion 10 of the lockable stop 8 as long as the lockable stop 8 is not yet swivelled in its operation position. The guide means connected with the housing is designated 33.

In FIG. 6 there is shown the pinion 25 of the stepping motor 20 in its position meshing with the toothed rack 5. The lockable stop 8 carries, as can clearly be seen in this representation, the gate-type guide 28 into which protrudes a pin 34 carried by a bell-crank lever 30. In this case the housing of the governor is designated 35.

As can be taken from FIG. 7, the gate-type guide 28 has a bent gate 36 which is engaged by said pin 34 which can be swivelled around the pivotal axis 29 by the solenoid 31 via the bell-crank lever 30. In the representation of FIG. 7, the lockable stop 8 is brought into its end position by means of the carrier bolts 32 and the shut-down spring 17 is fully wound up. Subsequently, the lockable stop is swivelled in upward direction with the aid of the spring 15, the pin 34 entering the notch 37 of the gate 36. In this position, the lockable stop 8 remains locked in view of the position of its gate-type guide 28, the locking force being received by the bell-crank lever 30 in its bearing support at the axis 29. The shutdown force need thus not be compensated by the magnet. In case of a failure of the current supply, the solenoid 31 is deenergized and its armature is shifted in direction of the arrow 39 by means of the spring 38 so that the pin 34 leaves the notch 37. The stop 8 is now moved in left-hand direction under the action of the shut-down spring 17, the shifting path being limited by the length of the gate 36. During this movement, the fuel amount control rod 1 is shifted in direction of zero-delivery.

According to FIG. 8, the gate-type guide 28 is engaged by a bell-crank lever 41 being pivotable around a pivotal axis 14 and carrying at its free end a roller 42. The roller 42 can be caught within the gate 36 and, resp., gives free the movement of the lockable stop 8 after swivelling the bell-crank lever 42. The linking axis 40 is stationarily arranged relative to the housing. A centrifugal force measuring means having its centrifugal weigth designated 43 is connected to the cam shaft 23 of the fuel combustion engine. The centrifugal force measuring means has a measuring bushing 44 against which a roller 45 of the bell-crank lever 41 is resiliently supported. The roller 45 is maintained in engagement with the bushing 44 by the force of the spring 46. With increasing number of revolutions, the governor bushing 44 is moved in left-hand direction in the sense of the arrow 47, whereby the bell-crank lever 41 is swivelled and the rollers 42 are moved out of the locking position within the gate 36. In this manner, the fuel combustion engine is shut down if the admissible rotating speed is exceeded.

What is claimed is:

1. A device for shutting down a fuel injection combustion engine, in which a fuel amount control rod of an injection pump cooperates with an adjustable stop adapted to be locked, in operation, by a locking member in a position giving free the whole adjusting range of the fuel amount control rod and being acted upon in its locked position by a shut-down spring in the sense of moving the fuel amount control rod to zero-delivery, the locking member being releasable in dependence on an operating condition, characterized in that an adjusting member for adjusting the fuel amount is actuated by a servometer and acts on the fuel amount control rod with interposition of a drag spring, in that the lockable stop is connected with a further stop cooperating, on adjusting the adjusting member in direction of maximum fuel supply of the fuel amount control rod, with a counterstop of the adjusting member, the shut-down spring thereby being tensioned until engagement of the locking member is the lockable stop, and in that in operation the further stop is out of engagement with the counterstop of the adjusting member.

2. A device as in claim 1, characterized in that the locking member of the lockable stop is formed of an armature of an electromagnet which gives free the shut-down path of the lockable stop in deenergized condition.

3. A device as in claim 1, characterized in that the locking member is formed of a displaceable pin engaging a bent gate-type guide of the lockable stop.

4. A device as in claim 3, characterized in that the displaceable pin is displaceable against the force of a restoring spring.

5. A device as in claim 1, characterized in that the lockable stop and the further stop are arranged on a lever pivotal about an axis and acted upon by a spring and in that a third stop is arranged at a smaller distance from the pivotal axis of the lever than is said further stop.

6. A device as in claim 1, characterized in that said further stop is formed of a hook-like part of the lockable stop which, in a first pivotal position of the lockable stop, grips over a counterstop of the adjusting member and which, in a second pivotal position corresponding to the operating position, is out of engagement with the counterstop.

7. A device as in claim 1, characterized in that the lockable stop is resiliently pressed into the pivotal position corresponding to the operating position.

8. A device as in claim 1 wherein said servometer is a stepping motor.

9. A device as in claim 6 wherein said counterstop is formed of carrier bolts.

* * * * *